US009847575B2

(12) United States Patent
Wu

(10) Patent No.: US 9,847,575 B2
(45) Date of Patent: Dec. 19, 2017

(54) ELECTRONIC DEVICE AND ANTENNA THEREOF

(71) Applicant: Wistron Corp., New Taipei (TW)

(72) Inventor: Jian Rong Wu, New Taipei (TW)

(73) Assignee: Wistron Corp., New Taipei (TW)

( * ) Notice: Subject to any disclaimer, the term of this patent is extended or adjusted under 35 U.S.C. 154(b) by 3 days.

(21) Appl. No.: 15/177,278

(22) Filed: Jun. 8, 2016

(65) Prior Publication Data

US 2017/0237166 A1 Aug. 17, 2017

(30) Foreign Application Priority Data

Feb. 16, 2016 (TW) ..... 105104433 A

(51) Int. Cl.

| | |
|---|---|
| ***H01Q 1/38*** | (2006.01) |
| ***H01Q 5/307*** | (2015.01) |
| ***H01Q 1/24*** | (2006.01) |
| ***H01Q 9/04*** | (2006.01) |

(52) U.S. Cl.

CPC ..... *H01Q 5/307* (2015.01); *H01Q 1/241* (2013.01); *H01Q 9/0414* (2013.01)

(58) Field of Classification Search

CPC ..... A61G 17/08; H01Q 1/243; H01Q 1/38; H01Q 5/374; H01Q 9/04; H01Q 9/0421; H01Q 1/22

See application file for complete search history.

(56) References Cited

U.S. PATENT DOCUMENTS

| | | | | |
|---|---|---|---|---|
| 7,289,071 | B2 * | 10/2007 | Hung | H01Q 9/42 343/702 |
| 7,375,686 | B2 * | 5/2008 | Ku | H01Q 1/2216 343/700 MS |
| 8,928,531 | B2 * | 1/2015 | Hu | H01Q 1/243 343/700 MS |
| 2002/0140607 | A1 * | 10/2002 | Zhou | H01Q 1/243 343/700 MS |
| 2004/0090375 | A1 * | 5/2004 | Dai | H01Q 9/42 343/700 MS |
| 2010/0238072 | A1 * | 9/2010 | Ayatollahi | H01Q 1/243 343/700 MS |
| 2015/0180117 | A1 * | 6/2015 | Ruan | H01Q 9/0421 343/841 |

FOREIGN PATENT DOCUMENTS

TW M365554 U1 9/2009

OTHER PUBLICATIONS

Taiwan Patent Office, Office Action, Patent Application Serial No. 105104433, dated Nov. 10, 2016, Taiwan.

* cited by examiner

*Primary Examiner* — Tho G Phan

(57) ABSTRACT

An antenna is provided. The antenna includes a first radiator, a second radiator, a third radiator, a ground portion and a short structure. The first radiator extends in a first direction. The second radiator extends in a second direction. The first direction is opposite to the second direction. The short structure is coupled to the ground portion. The first radiator, the second radiator and the third radiator are connected to the short structure. The short structure defines an L-shaped groove.

15 Claims, 7 Drawing Sheets

ELECTRONIC DEVICE AND ANTENNA THEREOF

CROSS REFERENCE TO RELATED APPLICATIONS

This Application claims priority of Taiwan Patent Application No. 105104433, filed on Feb. 16, 2016, the entirety of which is incorporated by reference herein.

BACKGROUND OF THE INVENTION

Field of the Invention

The present invention relates to an antenna, and in particular to an antenna disposed in an electronic device.

Description of the Related Art

A conventional antenna includes a system ground, a short pin, and a radiator. Conventionally, an antenna is H-shaped with a signal source and a ground line. Due to its being shielded by an extending ground and being influenced by a reversed current from the extending ground, the performance of the antenna is deteriorated. This is particularly true when an interference element (for example, an amplifier) is disposed above the antenna and shields the antenna, causing the performance of the antenna to be greatly reduced.

BRIEF SUMMARY OF THE INVENTION

In one embodiment of the invention, an antenna is provided. The antenna includes a first radiator, a second radiator, a third radiator, a ground portion, and a short structure. The first radiator extends in a first direction. The second radiator extends in a second direction. The first direction is opposite to the second direction. The short structure is coupled to the ground portion. The first radiator, the second radiator and the third radiator are connected to the short structure. The short structure defines an L-shaped groove.

In one embodiment, the third radiator extends in the second direction.

In one embodiment, the first radiator and the second radiator commonly transmit a high-band signal, and the third radiator transmits a low-band signal.

In one embodiment, the first radiator and the third radiator commonly transmit a high-band signal, and the second radiator transmits a low-band signal.

In one embodiment, the short structure comprises a feed section, an extending section and a short section, the extending section connects the feed section to the short section, a signal source is connected to the feed section, and the feed section has a curved structure.

In one embodiment, the feed section comprises a first end and a second end, the signal source is connected to the first end, the third radiator is connected to the first end, and the extending section is connected to the second end.

In one embodiment, the feed section comprises a first end, a second end and the curved portion, the signal source is connected to the first end, the third radiator is connected to the curved portion, and the extending section is connected to the second end.

In one embodiment, the extending section comprises a third end and a fourth end, the feed section is connected to the third end, the second radiator is connected to the third end, the short portion is connected to the fourth end, and the first radiator is connected to the fourth end.

In one embodiment, the extending section comprises a third end and a fourth end, the feed section is connected to the third end, the second radiator is connected to the third end, the short portion is connected to the fourth end, the short section comprises a fifth end and the sixth end, the fifth end is connected to the extending section, the sixth end is connected to the ground portion, and the first radiator is connected to the short section and is located between the fifth end and the sixth end.

In one embodiment, the feed section comprises a first section, a second section and a third section, the first section and the third section are connected to two respective ends of the second section, the signal source is connected to the first section, the extending section is connected to the third section, the second section is parallel to the extending section, and the first section and the third section are perpendicular to the second section.

In one embodiment, the feed section comprises a first section and a second section, the first section is parallel to the extending section, the signal source is connected to the first section, and the second section connects the extending section to the first section.

In one embodiment, an electronic device is provided. The electronic device includes a circuit board and an antenna. The antenna is coupled to the circuit board. The antenna includes a first radiator, a second radiator, a third radiator, a ground portion and a short structure. The first radiator extends in a first direction. The second radiator extends in a second direction. The first direction is opposite to the second direction. The short structure is coupled to the ground portion. The first radiator, the second radiator and the third radiator are connected to the short structure. The short structure defines an L-shaped groove.

In one embodiment, the electronic device further comprises an electronic element, wherein the electronic element overlaps the short structure, the first radiator, the second radiator and the third radiator of the antenna.

In one embodiment, the electronic element is an amplifier.

In one embodiment, the short structure comprises a feed section, an extending section and a short section, the extending section connects the feed section to the short section, a signal source is connected to the feed section, and the feed section has a curved structure.

Utilizing the antenna of the embodiment of the invention, by modifying the current distribution, the antenna radiation concentrated on the end of the antenna is decreased. Simultaneously, interference from the neighboring element (for example, amplifier) to the antenna is reduced. Utilizing the antenna of the embodiment of the invention, even with the neighboring electronic element (for example, an amplifier) shielding the antenna, the antenna provides favorable transmission in the high-band (5.3 G~5.6 G) and the low-band (2.4 G~2.48 G).

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
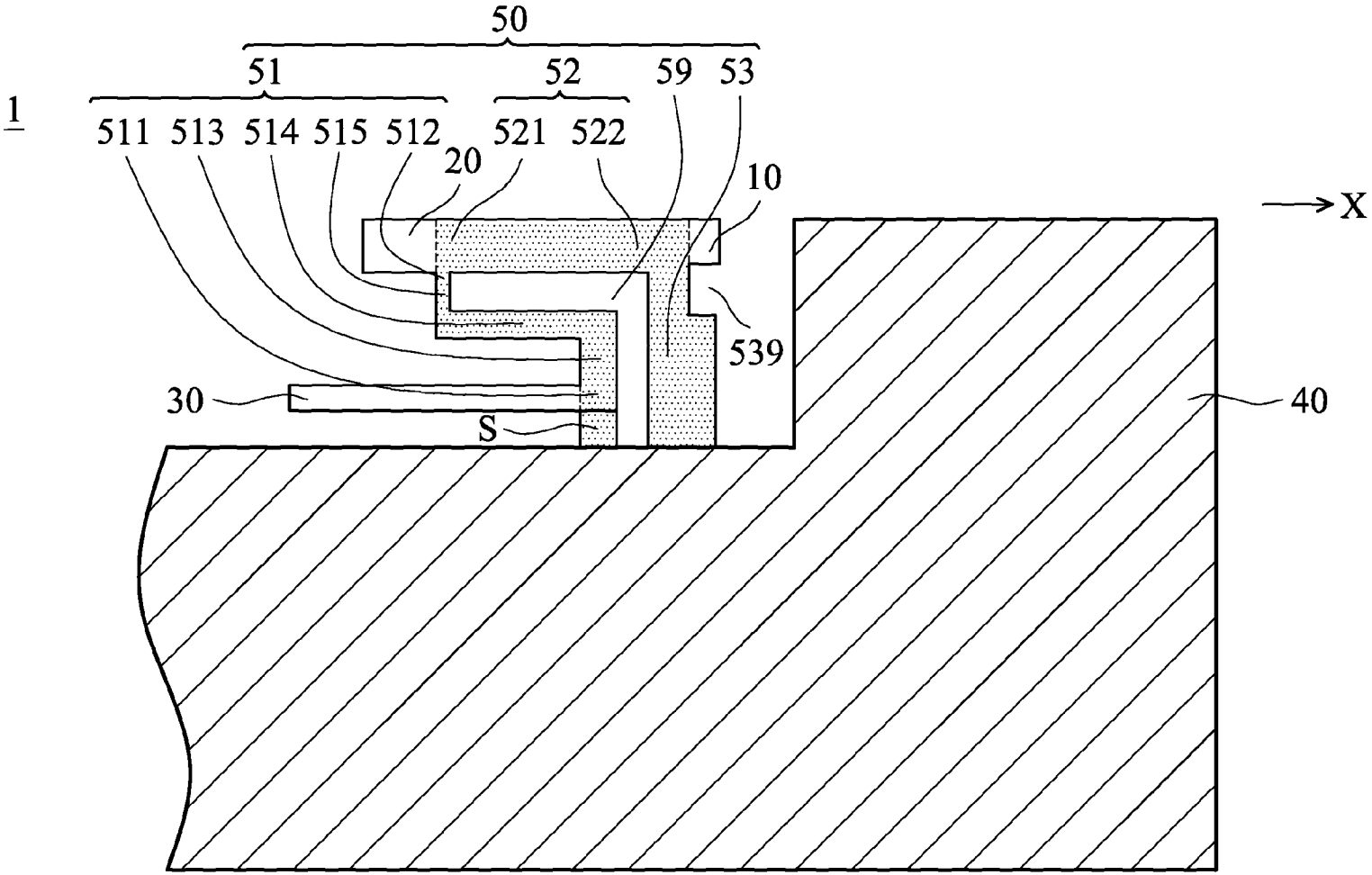
FIG. 1 shows an antenna of a first embodiment of the invention.

FIG. 1 shows an antenna 1 of a first embodiment of the invention. The antenna 1 includes a first radiator 10, a second radiator 20, a third radiator 30, a ground portion 40 and a short structure 50. The first radiator 10 extends in a first direction (X). The second radiator 20 extends in a second direction (−X). The first direction (X) is opposite to the second direction (−X). The short structure 50 is coupled to the ground portion 40 (in the embodiments of the invention, to clarify the description, the short structure 50 is represented by a dotted area). The first radiator 10, the second radiator 20 and the third radiator 30 are connected to the short structure 50. The short structure 50 defines an L-shaped groove 59.

With reference to FIG. 1, in this embodiment, the third radiator 30 extends in the second direction (−X). The first radiator 10 and the second radiator 20 have a common surface-current path to commonly transmit a high-band signal. In this embodiment, the lengths of the first radiator 10 and the second radiator 20 are about a quarter of the wavelength of the high-band signal. The third radiator 30 transmits a low-band signal. In one embodiment, the length of the third radiator 30 is about a quarter of the wavelength of the low-band signal. The dimensions and shape of the first radiator 10 and the second radiator 20 can be utilized to modify the frequency of the high-band signal. Similarly, the dimensions and shape of the third radiator 30 can be utilized to modify the frequency of the low-band signal.

With reference to FIG. 1, the short structure 50 comprises a feed section 51, an extending section 52, and a short section 53. The extending section 52 connects the feed section 51 to the short section 53. A signal source S is connected to the feed section 51, and the feed section 51 has a curved structure. Specifically, the feed section 51 comprises a first end 511 and a second end 512. The signal source S is connected to the first end 511, the third radiator 30 is connected to the first end 511, and the extending section 52 is connected to the second end 512. In one embodiment, the feed section 51 comprises a first section 513, a second section 514 and a third section 515. The first section 513 and the third section 515 are connected to two respective ends of the second section 514. The signal source S is connected to the first section 513. The extending section 52 is connected to the third section 515. The second section 514 is parallel to the extending section 52. The first section 513 and the third section 515 are perpendicular to the second section 514.

With reference to FIG. 1, in this embodiment, the extending section 52 comprises a third end 521 and a fourth end 522. The feed section 51 is connected to the third end 521. The second radiator 20 is connected to the third end 521. The short portion 53 is connected to the fourth end 522. The first radiator 10 is connected to the fourth end 522. In one embodiment, the first radiator 10, the extending section 52 and the second radiator 20 are located on the same straight line. However, the disclosure is not meant to restrict the invention. In other embodiments, the radiators are not necessarily on the same straight line as the extending section.

With reference to FIG. 1, in this embodiment, a notch 539 is formed on the short section 53. The location, dimensions, and shape of the notch 539 can be utilized to modify the impedance matching of the antenna.

Figure 2:
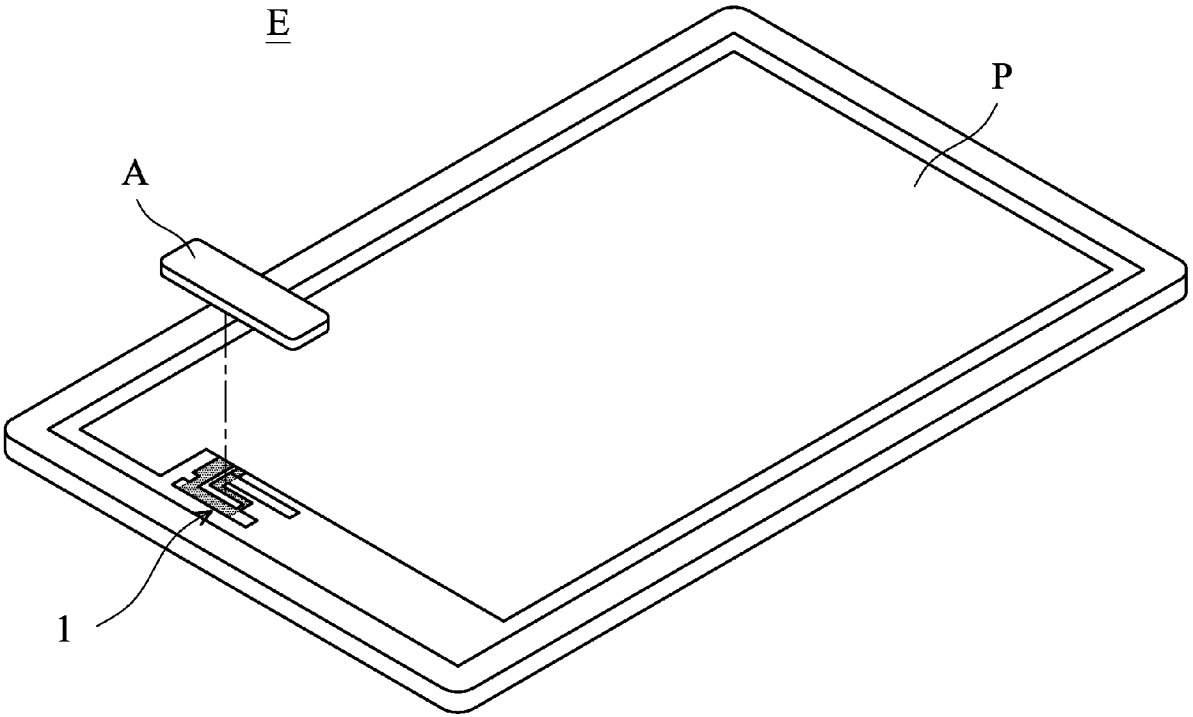
FIG. 2 shows the antenna of the embodiment of the invention disposed in an electronic device.
Figure 3:
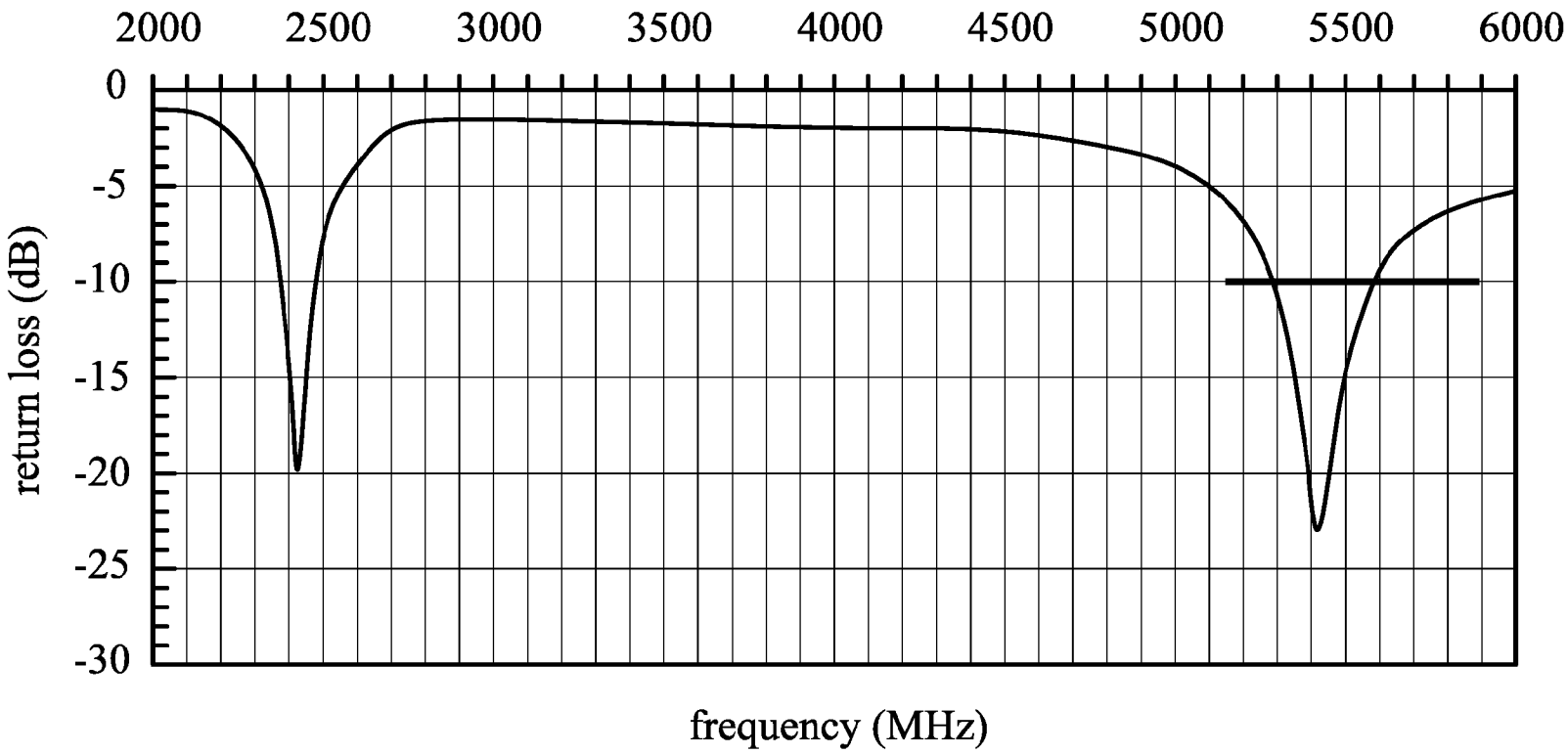
FIG. 3 shows the return loss of the antenna of the electronic device of the embodiment of the invention.

Utilizing the antenna of the embodiment of the invention, by modifying the current distribution, the antenna radiation concentrated on the end of the antenna is decreased. Simultaneously, interference from the neighboring element (for example, the amplifier) to the antenna is reduced. With reference to FIG. 2, the antenna 1 of the embodiment of the invention is adapted to be disposed in an electronic device E (For example, cell phone or tablet), which includes a circuit board P and the antenna 1 mentioned above. The antenna 1 is coupled to the circuit board P. In one embodiment, the electronic device E further comprises an electronic element A, wherein the electronic element A overlaps the short structure 50, the first radiator 10, the second radiator 20 and the third radiator 30 of the antenna 1. In one embodiment, the electronic element A is an amplifier. FIG. 3 shows the return loss of the antenna 1 of the electronic device E of the embodiment of the invention. With reference to FIG. 3, utilizing the antenna 1 of the embodiment of the invention, even with the electronic element A shielding the antenna, the antenna 1 provides favorable transmission in the high-band (5.3 G~5.6 G) and the low-band (2.4 G~2.48 G). In this embodiment, the bandwidth of the high-band (5.3G~5.6G) is 320 MHz, and the bandwidth of the low-band (2.4 G~2.48 G) is 100 MHz. The antenna 1 of the embodiment of the invention can satisfy Wi-Fi and Bluetooth transmission requirements.

Figure 4:
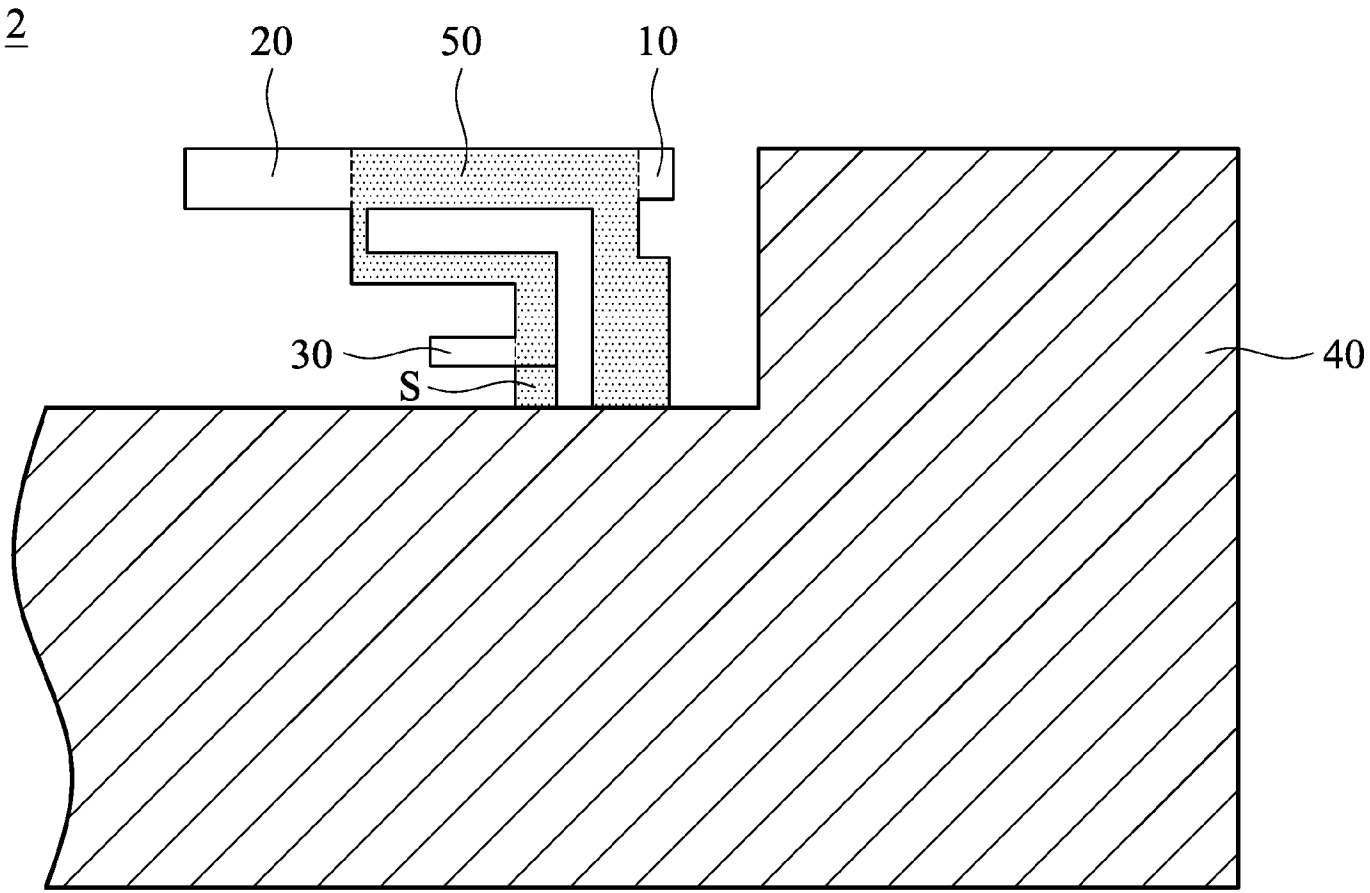
FIG. 4 shows an antenna of a second embodiment of the invention.

FIG. 4 shows an antenna 2 of a second embodiment of the invention, wherein the first radiator 10 and the third radiator 30 commonly transmit a high-band signal, and the second radiator 20 transmits a low-band signal.

Figure 5:
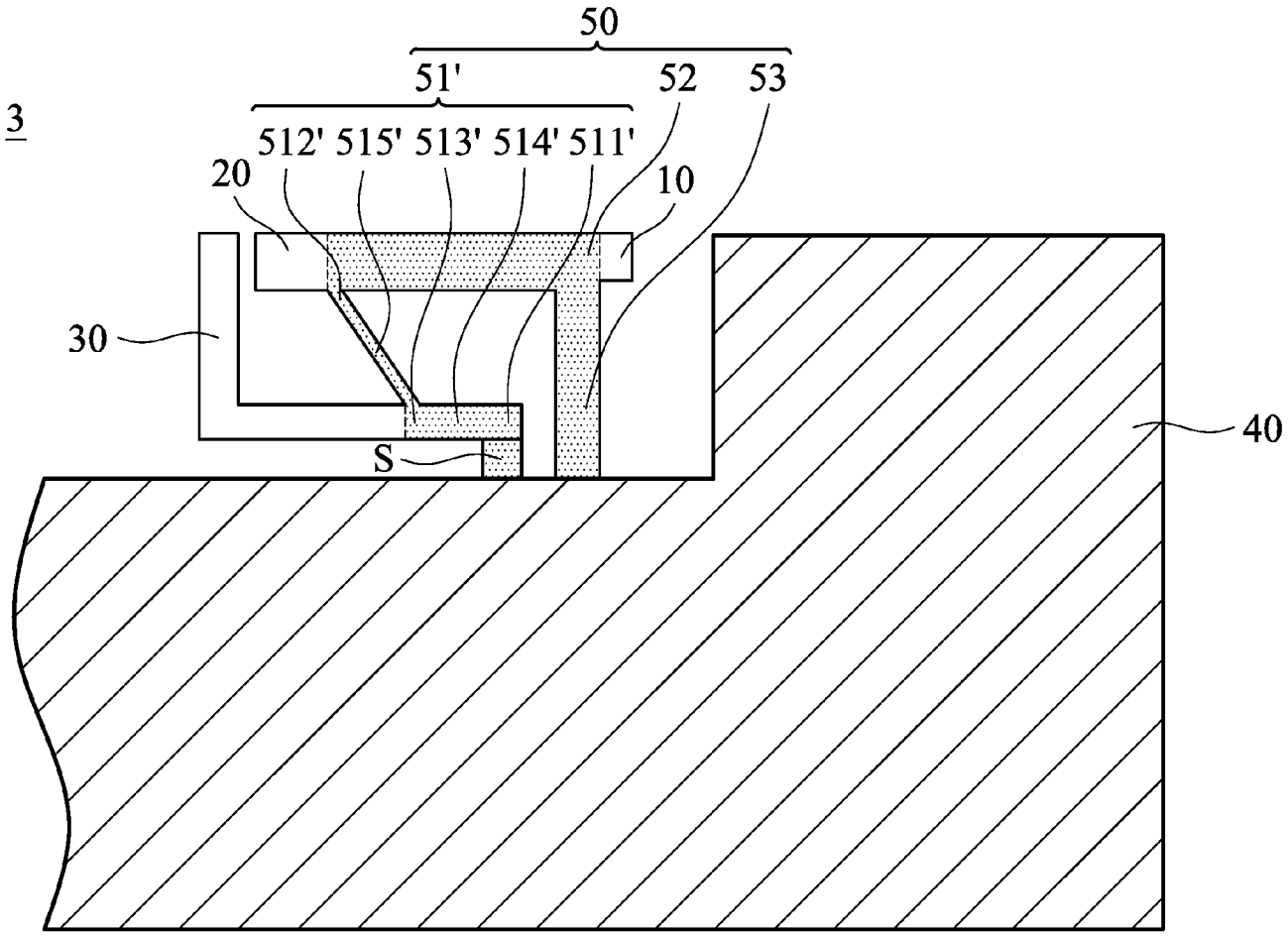
FIG. 5 shows an antenna of a third embodiment of the invention.

FIG. 5 shows an antenna 3 of a third embodiment of the invention, wherein the feed section 51' comprises a first end 511', a second end 512' and the curved portion 513'. The signal source S is connected to the first end 511', the third radiator 30 is connected to the curved portion 513', and the extending section 52 is connected to the second end 512'. In this embodiment, the third radiator 30 has a curved structure to reduce the dimensions of the antenna. The feed section 51' comprises a first section 514' and a second section 515'. The first section 514' is parallel to the extending section 52. The signal source S is connected to the first section 514', and the second section 515' connects the extending section 85 to the first section 514'. In this embodiment, the second section 515' extends outward and is tilted.

Figure 6:
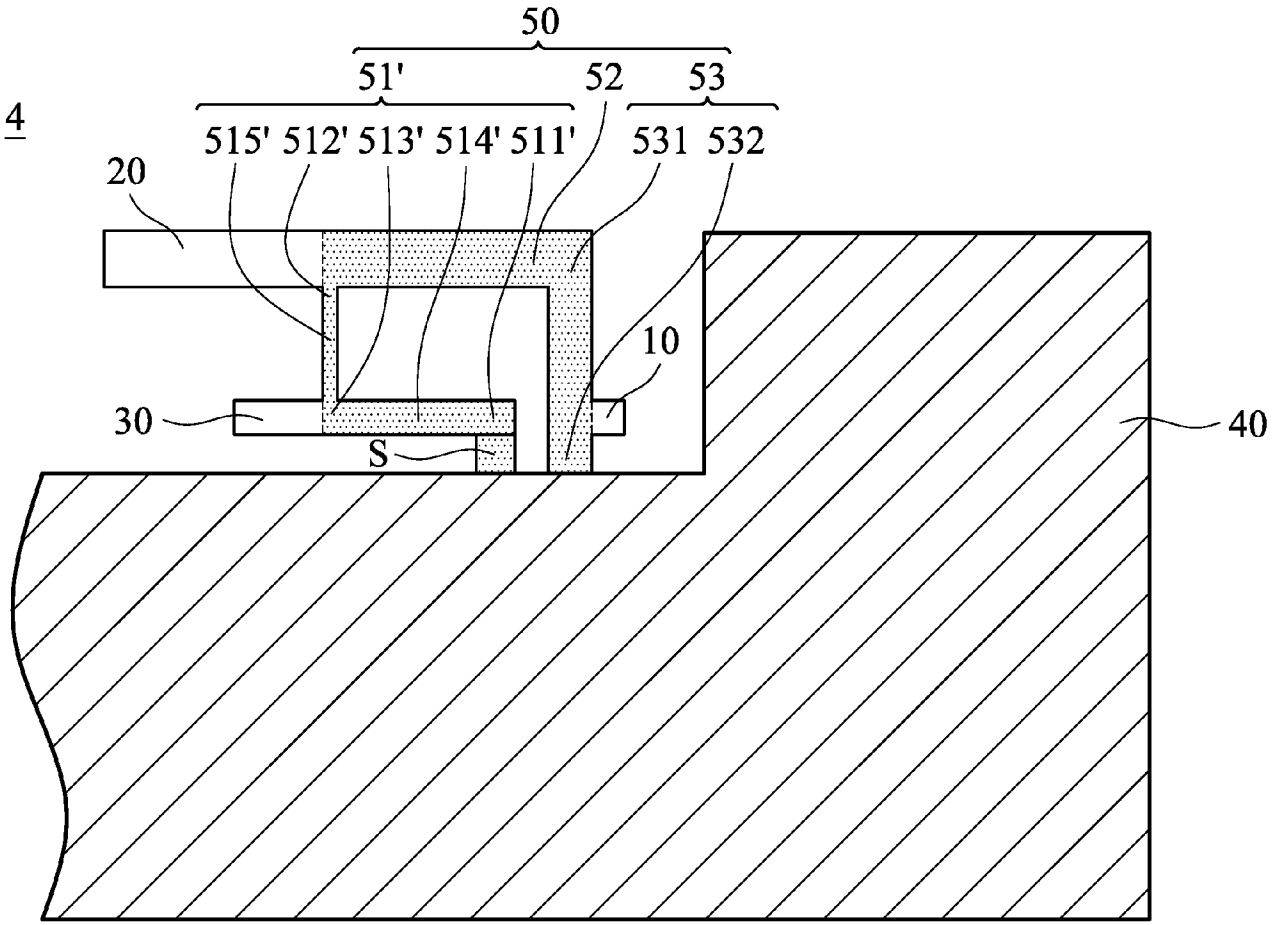
FIG. 6 shows an antenna of a fourth embodiment of the invention.

FIG. 6 shows an antenna 4 of a fourth embodiment of the invention. Compared to the third embodiment, the shape of the short structure 50 of the antenna 4 differs from that of the third embodiment. In this embodiment, the second section 515' is perpendicular to the extending section 52. Additionally, the first radiator 10 is moved to the same straight line with the third radiator 30. In this embodiment, the short section 53 comprises a fifth end 531 and a sixth end 532. The fifth end 531 is connected to the extending section 52. The sixth end 532 is connected to the ground portion 40. The first radiator 10 is connected to the short section 53 and is located between the fifth end 531 and the sixth end 532. In this embodiment, the first radiator 10 and the third radiator 30 commonly transmit a high-band signal, and the second radiator 20 transmits a low-band signal.

Figure 7:
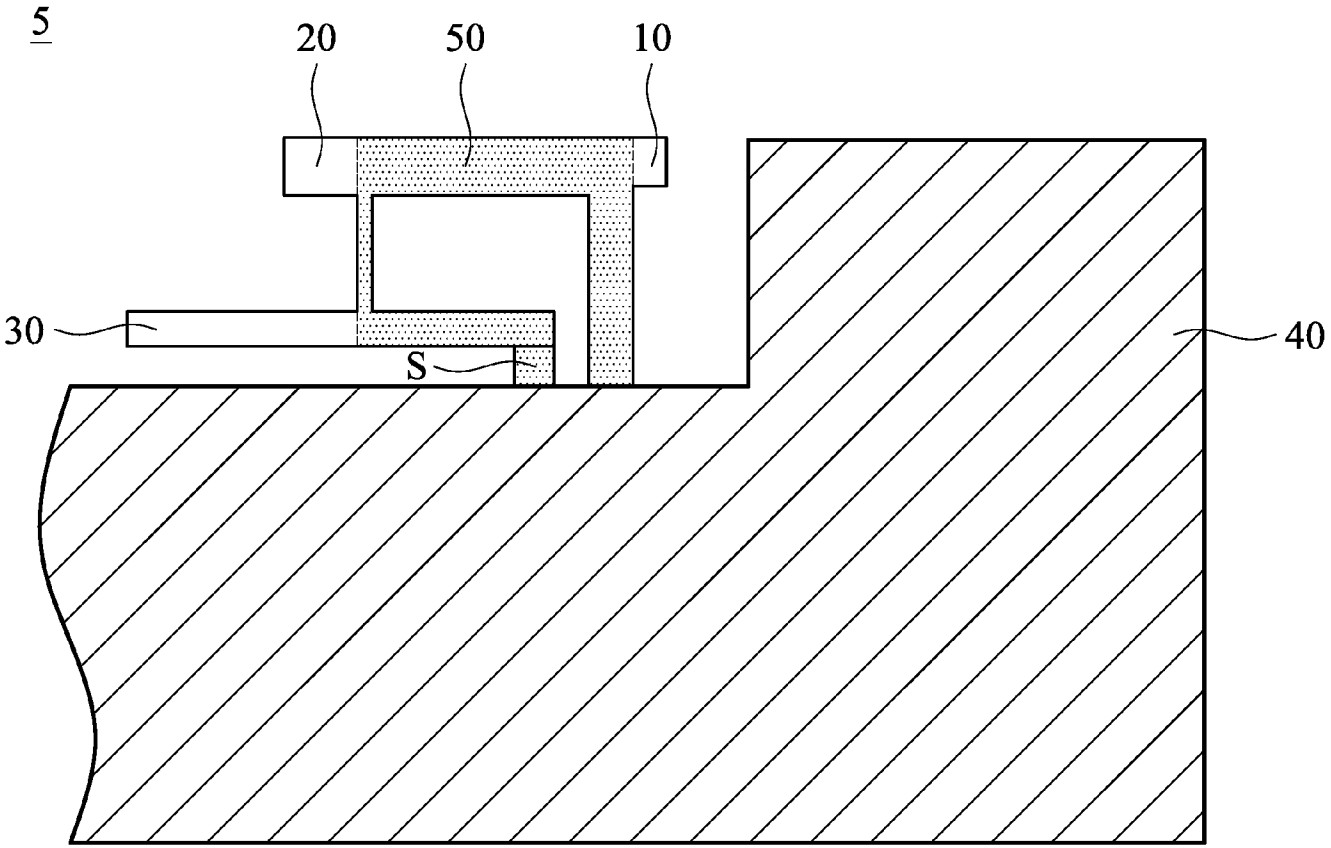
FIG. 7 shows an antenna of a fifth embodiment of the invention.

FIG. 7 shows an antenna 5 of a fifth embodiment of the invention. Compared to the embodiment of FIG. 6, the first radiator 10 and the second radiator 20 of the antenna 5 commonly transmit a high-band signal, and the third radiator 30 of the antenna 5 transmits a low-band signal.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a first radiator, extending in a first direction;

a second radiator, extending in a second direction, wherein the first direction is opposite to the second direction;

a third radiator;

a ground portion; and a short structure, coupled to the ground portion, wherein the first radiator, the second radiator and the third radiator are connected to the short structure, and the short structure solely defines an L-shaped groove.

2. The antenna as claimed in claim 1, wherein the third radiator extends in the second direction.

3. The antenna as claimed in claim 2, wherein the first radiator and the second radiator commonly transmit a high-band signal, and the third radiator transmits a low-band signal.

4. The antenna as claimed in claim 2, wherein the first radiator and the third radiator commonly transmit a high-band signal, and the second radiator transmits a low-band signal.

5. The antenna as claimed in claim 2, wherein the short structure comprises a feed section, an extending section and a short section, the extending section connects the feed section to the short section, a signal source is connected to the feed section, and the feed section has a curved structure.

6. The antenna as claimed in claim 5, wherein the feed section comprises a first end and a second end, the signal source is connected to the first end, the third radiator is connected to the first end, and the extending section is connected to the second end.

7. The antenna as claimed in claim 5, wherein the feed section comprises a first end, a second end and the curved portion, the signal source is connected to the first end, the third radiator is connected to the curved portion, and the extending section is connected to the second end.

8. The antenna as claimed in claim 5, wherein the extending section comprises a third end and a fourth end, the feed section is connected to the third end, the second radiator is connected to the third end, the short portion is connected to the fourth end, and the first radiator is connected to the fourth end.

9. The antenna as claimed in claim 5, wherein the extending section comprises a third end and a fourth end, the feed section is connected to the third end, the second radiator is connected to the third end, the short portion is connected to the fourth end, the short section comprises a fifth end and the sixth end, the fifth end is connected to the extending section, the sixth end is connected to the ground portion, and the first radiator is connected to the short section and is located between the fifth end and the sixth end.

10. The antenna as claimed in claim 5, wherein the feed section comprises a first section, a second section and a third section, the first section and the third section are connected to two respective ends of the second section, the signal source is connected to the first section, the extending section is connected to the third section, the second section is parallel to the extending section, and the first section and the third section are perpendicular to the second section.

11. The antenna as claimed in claim 5, wherein the feed section comprises a first section and a second section, the first section is parallel to the extending section, the signal source is connected to the first section, and the second section connects the extending section to the first section.

12. An electronic device, comprising:

a circuit board; and an antenna, coupled to the circuit board, comprising:

a first radiator, extending in a first direction;

a second radiator, extending in a second direction, wherein the first direction is opposite to the second direction;

a third radiator;

a ground portion; and a short structure, coupled to the ground portion, wherein the first radiator, the second radiator and the third radiator are connected to the short structure, and the short structure solely defines an L-shaped groove.

13. The electronic device as claimed in claim 12, further comprising an electronic element, wherein the electronic element overlaps the short structure, the first radiator, the second radiator and the third radiator of the antenna.

14. The electronic device as claimed in claim 13, wherein the electronic element is an amplifier.

15. The electronic device as claimed in claim 12, wherein the short structure comprises a feed section, an extending section and a short section, the extending section connects the feed section to the short section, a signal source is connected to the feed section, and the feed section has a curved structure.

* * * * *